US009895280B2

(12) United States Patent
Ma et al.

(10) Patent No.: US 9,895,280 B2
(45) Date of Patent: Feb. 20, 2018

(54) HEAD MASSAGER AND HELMET SIZE ADJUSTING STRUCTURE THEREOF

(71) Applicant: SHENZHEN BREO TECHNOLOGY CO., LTD., Shenzheng (CN)

(72) Inventors: Xuejun Ma, Shenzhen (CN); Yong Wan, Shenzhen (CN)

(73) Assignee: SHENZHEN BREO TECHNOLOGY CO., LTD., Shenzhen, Guangdong (CN)

( * ) Notice: Subject to any disclaimer, the term of this patent is extended or adjusted under 35 U.S.C. 154(b) by 419 days.

(21) Appl. No.: 14/766,393

(22) PCT Filed: Jan. 20, 2015

(86) PCT No.: PCT/CN2015/071130
§ 371 (c)(1),
(2) Date: Aug. 6, 2015

(87) PCT Pub. No.: WO2015/169113
PCT Pub. Date: Nov. 12, 2015

(65) Prior Publication Data

US 2016/0250092 A1 Sep. 1, 2016

(30) Foreign Application Priority Data

May 9, 2014 (CN) ..... 2014 1 0196501

(51) Int. Cl.
*A61H 1/00* (2006.01)
*A42B 7/00* (2006.01)
(Continued)

(52) U.S. Cl.
CPC ..... *A61H 1/008* (2013.01); *A42B 3/324* (2013.01); *A61H 7/006* (2013.01); *A61H 2201/0192* (2013.01); *A61H 2205/02* (2013.01)

(58) Field of Classification Search
None
See application file for complete search history.

(56) References Cited

U.S. PATENT DOCUMENTS 5,357,654 A * 10/1994 Hsing-Chi ..... A42B 3/145 2/418
5,950,245 A * 9/1999 Binduga ..... A42B 3/145 2/183
(Continued)

FOREIGN PATENT DOCUMENTS

CN 201775757 3/2011
CN 102273761 12/2011
(Continued)

OTHER PUBLICATIONS

English translation of International Search Report for PCT/CN2015/071130, dated Apr. 27, 2015, 3 pages total.

*Primary Examiner* — Stephen R Crow
(74) *Attorney, Agent, or Firm* — Hamre, Schumann, Mueller & Larson, P.C.

(57) ABSTRACT

The present invention relates to the technical field of massagers and provides a head massager and a helmet size adjusting structure thereof. The helmet size adjusting structure includes two racks and an adjusting apparatus, the adjusting apparatus includes a revolving shaft and a gear, an upper part and a lower part of the gear are separately engaged with the racks, and a knob component and a locking component are disposed on the revolving shaft; and the structure further includes two tension springs, where front ends of the tension springs are fastened on a rear housing and rear ends of the tension springs are separately fastened on the two racks; the knob component includes a knob outer ring, a knob shell, and a gear stand; the locking component includes a knob lock, an upper cover of the knob lock, and an elastic element; the gear stand is located inside the knob lock, a unidirectional gear ring is disposed on the gear stand, a lock that can be clamped on the unidirectional gear ring is disposed on the knob lock, and the elastic element is disposed on the upper cover of the knob lock; and teeth are
(Continued)

further disposed on the gear stand, where the teeth are engaged with the gear. In the present invention, a knob and a button are designed as a whole and helmet adjustment is implemented by using two manners, its operation is more convenient, and an inner structure is more reliable.

10 Claims, 6 Drawing Sheets

(51) Int. Cl.
*A42B 3/32* (2006.01)
*A61H 7/00* (2006.01)

(56) References Cited

U.S. PATENT DOCUMENTS 6,256,798 B1 * 7/2001 Egolf ..... A42B 3/08 2/417
6,708,376 B1 * 3/2004 Landry ..... A42B 3/145 2/418
7,000,262 B2 * 2/2006 Bielefeld ..... A42B 3/145 2/418
7,174,575 B1 * 2/2007 Scherer ..... A42B 3/145 2/418
7,219,370 B1 * 5/2007 Teetzel ..... A42B 3/04 2/422
7,565,704 B2 * 7/2009 Wu ..... A42B 3/145 2/410
7,707,695 B2 * 5/2010 Dubois ..... A42B 3/145 2/418
7,854,024 B2 * 12/2010 Fang ..... A42B 3/145 2/417
8,056,150 B2 * 11/2011 Stokes ..... A42B 3/145 2/417
8,161,576 B2 * 4/2012 Lemke ..... A61F 9/06 2/417
8,296,868 B2 * 10/2012 Belanger ..... A42B 3/324 2/414
8,370,967 B2 * 2/2013 Chen ..... A42B 3/145 2/414
8,832,869 B2 * 9/2014 Ma ..... A61H 7/006 2/418
9,572,392 B2 * 2/2017 Klotz ..... A42B 3/145
2008/0109947 A1 5/2008 Dubois
2009/0222978 A1 * 9/2009 Fang ..... A42B 3/085 2/421
2011/0191946 A1 8/2011 Fang

FOREIGN PATENT DOCUMENTS

| | | |
|---|---|---|
| CN | 202335386 | 7/2012 |
| CN | 202568799 | 12/2012 |
| CN | 103006410 | 4/2013 |
| CN | 202961094 | 6/2013 |
| CN | 203315002 | 12/2013 |
| CN | 203935392 | 1/2014 |
| CN | 103622809 | 3/2014 |
| CN | 103976858 | 8/2014 |
| CN | 204147239 | 2/2015 |
| EP | 0796568 | 9/1997 |

* cited by examiner

HEAD MASSAGER AND HELMET SIZE ADJUSTING STRUCTURE THEREOF

TECHNICAL FIELD

The present invention relates to the technical field of massagers, and more specifically, to a head massager and a helmet size adjusting structure thereof.

BACKGROUND

To apply to different people for use, a helmet for an existing head massager is generally adjustable in terms of a size. Head massager series produced by our company can be pulled by hand to move a first housing and a second housing relatively, thereby implementing spacing adjustment. A structure for this type of spacing adjustment is not easy to operate and has relatively poor reliability, and the structure is complex and high-cost, and therefore, improvement is urgently needed.

SUMMARY

An objective of the present invention is to provide a head massager and a helmet size adjusting structure thereof, so as to solve problems of difficult operation, poor reliability, and high cost that exist in the prior art.

To solve the foregoing technical problem, a technical solution of the present invention is: providing a helmet size adjusting structure, where the structure is disposed between a front housing and a rear housing of a helmet of a head massager and includes two racks that connect the front housing and the rear housing; rear ends of the two racks overlap each other, and an overlapping part is relatively contracted or expanded by using an adjusting apparatus; the adjusting apparatus includes a revolving shaft that extends from outside to inside and a gear disposed on an inner end of the revolving shaft, an upper part and a lower part of the gear are separately engaged with the racks, and a knob component and a locking component that locks the knob component are further disposed on an outer end of the revolving shaft; and the structure further includes two tension springs, where front ends of the tension springs are fastened on the rear housing and rear ends of the tension springs are separately fastened on the two racks; the knob component includes a knob outer ring, a knob shell that matches the knob outer ring, and a gear stand that is disposed inside the knob shell and can turn with the knob outer ring and the knob shell; the locking component includes a knob lock disposed inside the knob outer ring and the knob shell, an upper cover of the knob lock that is clamped with the knob lock, and an elastic element; the gear stand is located inside the knob lock, a unidirectional gear ring is disposed on the gear stand, a lock that can be clamped on the unidirectional gear ring is disposed on the knob lock, and the elastic element is disposed on the upper cover of the knob lock and configured to press against the upper cover of the knob lock so as to press on the knob lock, thereby matching the lock with the unidirectional gear ring for locking; teeth are further disposed on the gear stand, where the teeth pass through the knob lock and the knob shell in turn to engage with the gear.

Specifically, the gear stand includes a base body and a protrusion on the base body, the unidirectional gear ring is arranged by surrounding one surface of the base body, the teeth are disposed on the protrusion, and the teeth are in two groups and arranged in opposition to each other.

Specifically, two mounting studs are further disposed on the base body, the two mounting studs are arranged symmetrically to the protrusion, a mounting hole is disposed on each mounting stud, and connecting pins that can separately extend into the mounting holes are disposed correspondingly on the knob shell; two connecting holes are disposed on an inner side of the knob outer ring and connecting bumps that can be separately clamped into the two connecting holes are disposed on an inner side of the knob shell.

Specifically, a first card slot is further disposed on an inner side of the knob lock, a first card hook extending to an inner side is disposed on the upper cover of the knob lock, and the first card hook is disposed inside the first card slot, with the hook extending outwards.

Specifically, a boss extends from a center of the upper cover of the knob lock to the inner side, the elastic element is sleeved on the boss, the revolving shaft passes through a center of the boss, one step is disposed on the revolving shaft, and another end of the elastic element presses against the step.

Specifically, one anti-rotating spacer is further fastened on the upper cover of the knob lock.

Specifically, a central hole is disposed on the anti-rotating spacer, an end of the revolving shaft extends out of the central hole and is fastened by using a screw, and a connecting shaft that is correspondingly inserted into the upper cover of the knob lock is further disposed on the anti-rotating spacer.

Specifically, a knob button is further disposed on an outer side of the upper cover of the knob lock, the knob outer ring is hollow inside, and the knob button is exposed in a hollow hole of the knob outer ring.

Specifically, a second card slot is disposed on the upper cover of the knob lock and a second card hook that can be clamped into the second card slot is disposed on the knob button.

The present invention further provides a head massager that includes a helmet, where the foregoing size adjusting structure is disposed symmetrically on the helmet.

In this embodiment, when a helmet needs to be turned down, a knob outer ring is rotated and the knob outer ring drives a gear stand to turn. Because a gear ring matching the gear stand with a lock of a knob lock is unidirectional, the gear stand and the lock are unlocked by using a slope effect between the gear ring and the lock. The gear stand turns and drives a gear to turn and the gear drives two racks to become contracted relatively. Consequently, a front housing moves backwards and the helmet is turned down. In this process, rear ends of two tension springs separately move with the two racks, the two tension springs are elongated and when the racks are adjusted to a proper position, the knob outer ring is loosened, the knob lock again matches the unidirectional gear ring of the gear stand for locking under an elastic pressure effect of an elastic element, the gear stand and the gear cannot turn, and therefore, the front housing and a rear housing are relatively fixed; when a user is in a massaging process and feels that massaging strength is too intense to bear or does not want massaging, or want to turn up the helmet, the user presses an upper cover of the knob lock and uses the elastic element to move the knob lock in reverse to unlock the gear stand. In this way, the gear stand can be turned, the gear is no longer restricted, the tension springs are released, and the front housing immediately rebounds forwards, the racks are moved and reset under an effect of the tension springs, thereby enlarging spacing between the front housing and the rear housing, that is, the helmet is turned up. In the foregoing size adjusting structure, a knob and a button are designed as a whole, helmet adjustment is implemented by using two manners, and this operation structure is more convenient and an inner structure is more reliable.

Figure 1:
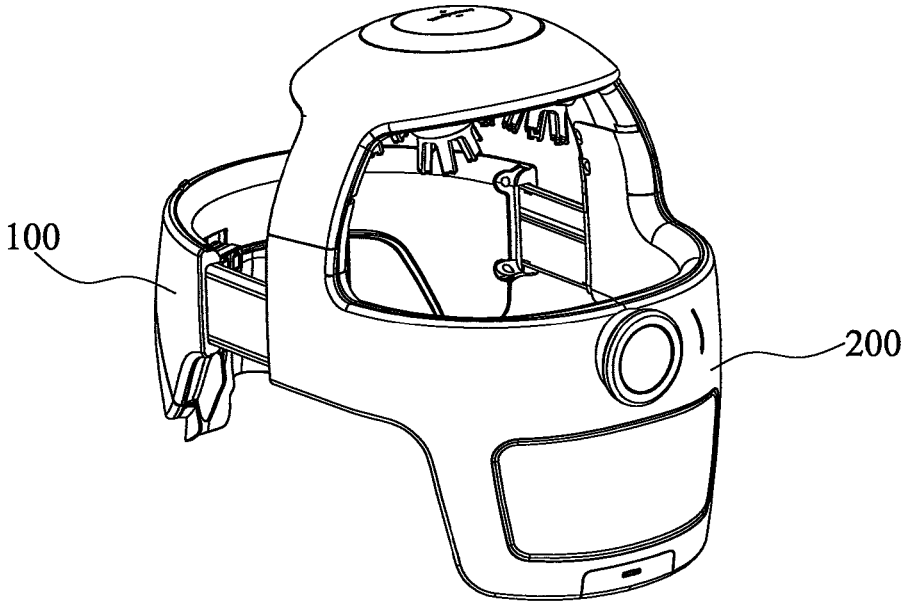
FIG. 1 is a schematic structural diagram of a helmet of a head massager when the helmet is turned up according to an embodiment of the present invention.
Figure 2:
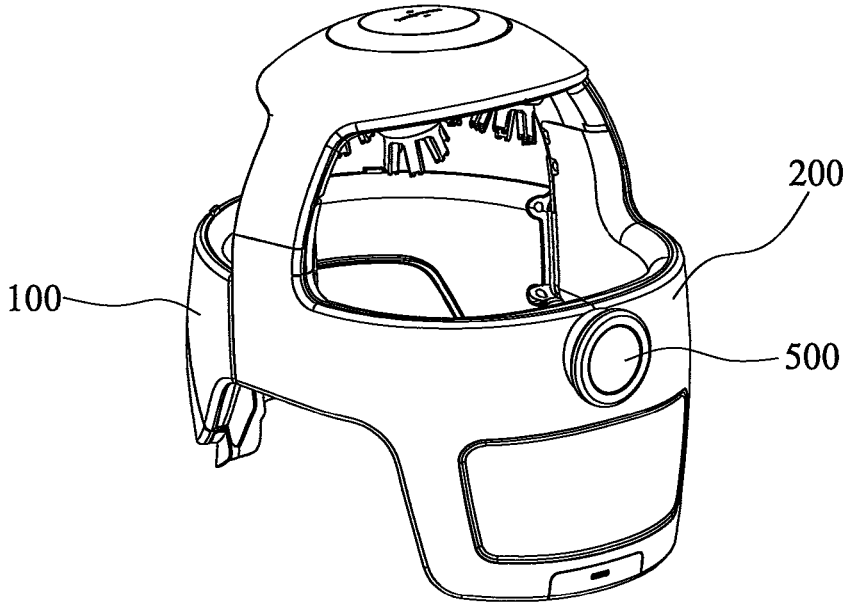
FIG. 2 is a schematic structural diagram of a helmet of a head massager when the helmet is turned down according to an embodiment of the present invention.
Figure 3:
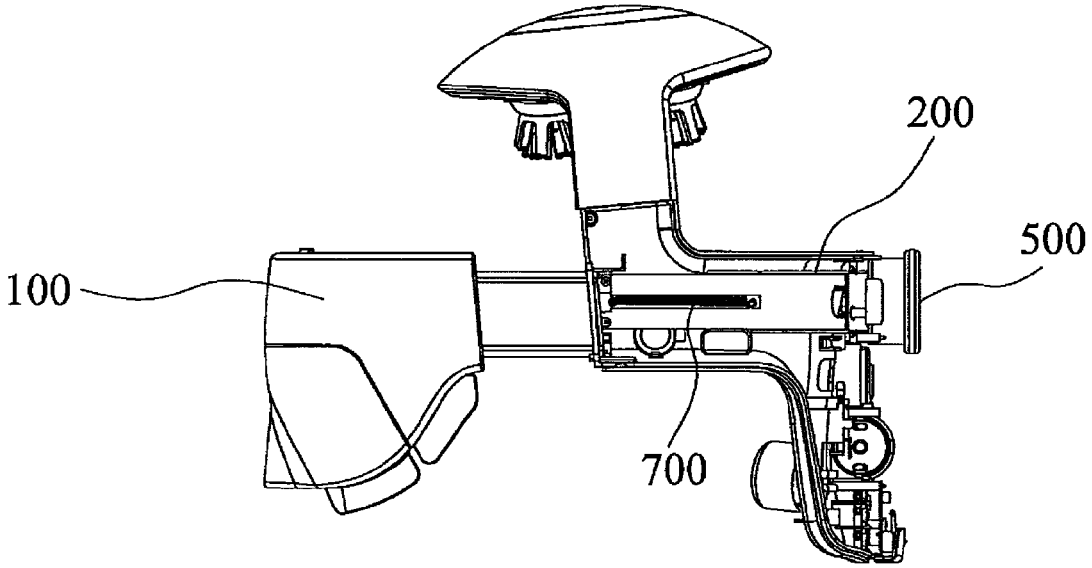
FIG. 3 is a side view of a helmet of a head massager when the helmet is turned up according to an embodiment of the present invention.
Figure 4:
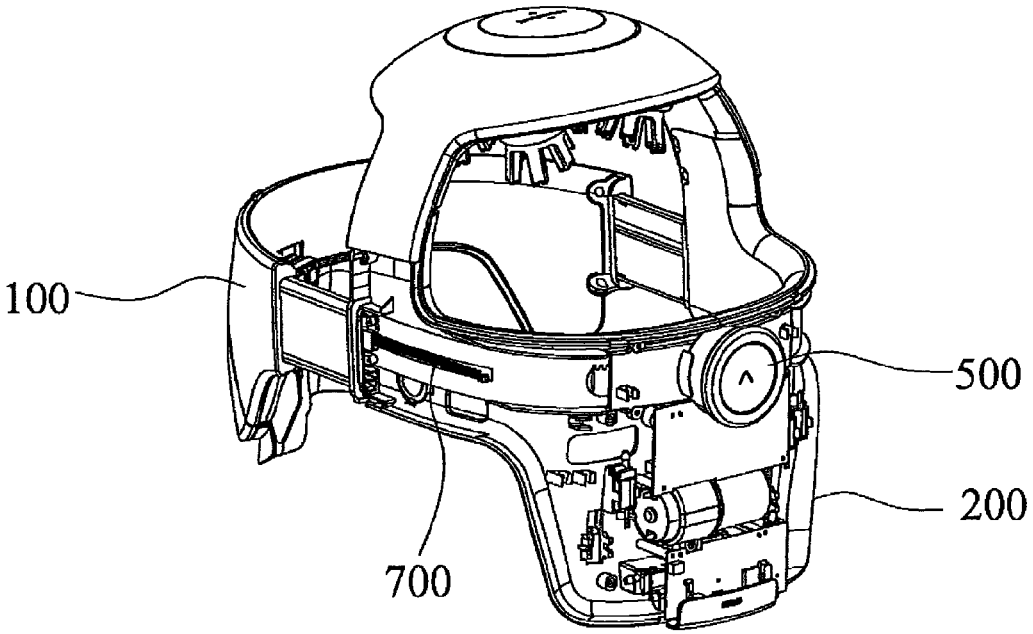
FIG. 4 is a schematic structural diagram of a helmet of a head massager when the helmet is turned up and a rear housing panel is removed according to an embodiment of the present invention.
Figure 5:
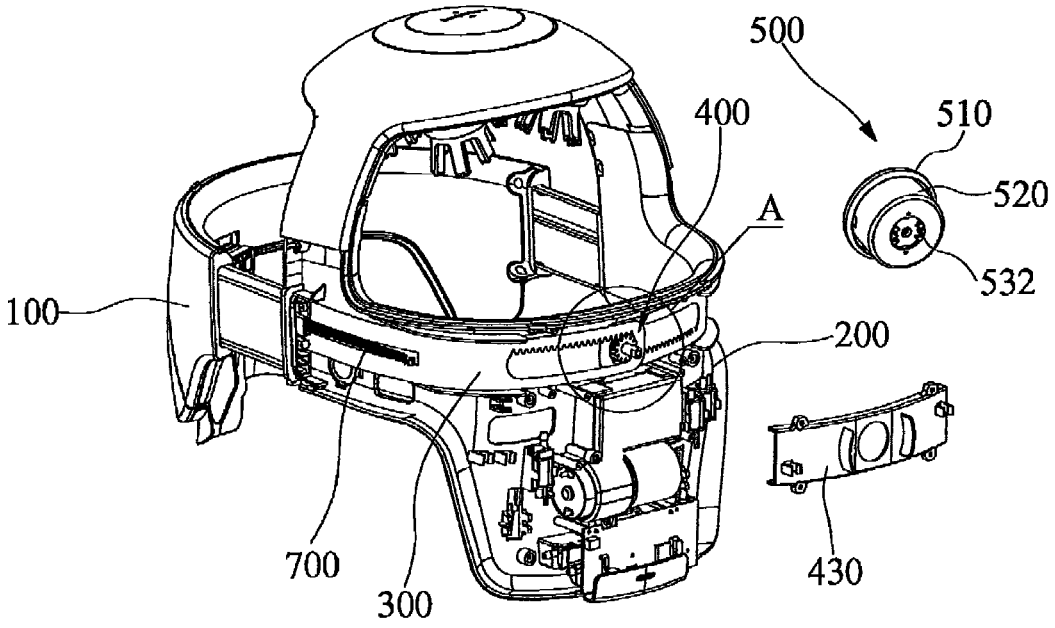
FIG. 5 is an exploded view of a helmet of a head massager according to an embodiment of the present invention.
Figure 6:
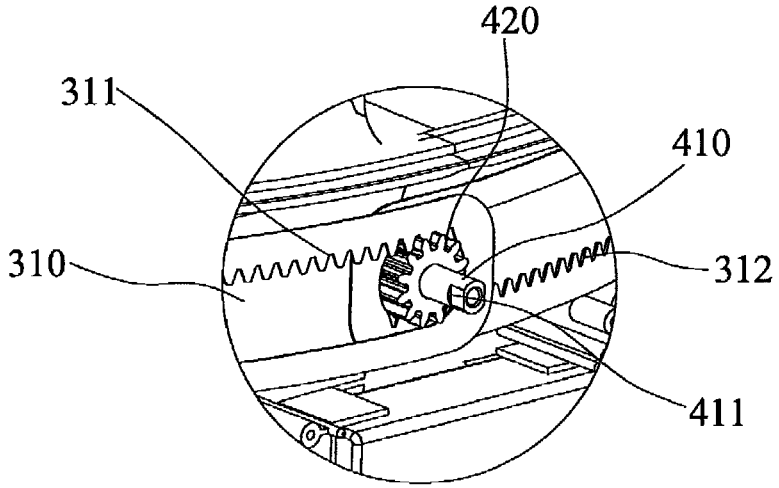
FIG. 6 is an enlarged view of a position A of FIG. 5.

100—Front housing; 200—Rear housing; 300—Rack; 310—Tooth space;

311—Upper teeth; 312—Lower teeth; 400—Adjusting apparatus; 410—Revolving shaft;

411—Step; 420—Gear; 430—Gear cover; 500—Knob component;

510—Knob outer ring; 511—Connecting hole; 520—Knob shell; 521—Base plate;

522—Connecting pin; 523—Connecting bump; 530—Gear base; 531—Unidirectional gear ring;

532—Teeth; 533—Base; 534—Protrusion; 535—Mounting stud;

5351—Mounting hole; 600—Locking component; 610—Knob lock; 611—Lock;

612—First card slot; 613—Opening; 620—Upper cover of the knob lock; 621—First card hook;

622—Card block; 623—Boss; 624—Second card slot; 630—Elastic element;

640—Knob button; 641—Second card hook; 700—Tension spring; 800—Anti-rotating spacer;

810—Central hole; and 820—Connecting shaft.

DESCRIPTION OF EMBODIMENTS

To make the objectives, technical solutions, and advantages of the present invention clearer and more comprehensible, the following further describes the present invention in detail with reference to the accompanying drawings and embodiments. It should be understood that the specific embodiments described herein are merely used to explain the present invention but are not intended to limit the present invention.

Referring to FIG. 1 to FIG. 4, the present invention provides a head massager. The head massager is in a shape of a helmet, the helmet is formed by combining a front housing 100 and a rear housing 200, and a size of the helmet is implemented by using a size adjusting structure disposed between the front housing 100 and the rear housing 200, thereby adapting to head shapes of different users.

Referring to FIG. 5 to FIG. 8, the helmet size adjusting structure includes two racks 300 that connect the front housing 100 and the rear housing 200. Front ends of the two racks 300 are separately connected to the front housing 100, rear ends of the two racks 300 overlap each other on the rear housing 200, and an overlapping part is relatively contracted or expanded by using an adjusting apparatus 400, thereby driving the front housing 100 to move relatively to the rear housing 200. Specifically, the adjusting apparatus 400 includes a revolving shaft 410 that extends from outside to inside of the rear housing 200 and a gear 420 disposed on an inner end of the revolving shaft 410. Tooth space 310 is provided on both overlapping parts of the two racks 300, where upper teeth 311 are disposed on tooth space 310 of one rack 300, lower teeth 312 are disposed on tooth space 310 of another rack 300, and an upper part and a lower part of the gear 420 are engaged with the upper teeth 311 and the lower teeth 312 respectively. In this way, when being turned, the gear 420 is engaged with the upper teeth 311 and the lower teeth 312 to drive the two racks 300 to become relatively contracted or expanded, so that the helmet can be turned down or turned up. A gear cover 430 is further fastened on an outer side of the gear 420. A knob component 500 and a locking component 600 that locks the knob component 500 are further disposed on an outer end of the revolving shaft 410. The knob component 500 includes a knob outer ring 510, a knob shell 520 that matches the knob outer ring 510, and a gear stand 530 that is disposed inside the knob shell 520 and can turn with the knob outer ring 510 and the knob shell 520. The locking component 600 includes a knob lock 610 disposed inside the knob outer ring 510 and the knob shell 520, an upper cover 620 of the knob lock that is clamped with the knob lock 610, and an elastic element 630. The gear stand 530 is located inside the knob lock 610, a unidirectional gear ring 531 is disposed on the gear stand 530, and a lock 611 that can be clamped on the unidirectional gear ring 531 is disposed on the knob lock 610. In this way, by matching the lock 611 with the unidirectional gear ring 531, the gear stand 530 is locked and prevented from turning. In addition, the elastic element 630 is disposed on the upper cover 620 of the knob lock and configured to press against the upper cover 620 of the knob lock so as to press on the knob lock 610, thereby matching the lock 611 with the unidirectional gear ring 531 for locking. Teeth 532 are further disposed on the gear stand 530, where the teeth 532 pass through the knob lock 610 and the knob shell 520 in turn to engage with the gear 420. In this embodiment, the size adjusting structure further includes two tension springs 700, where front ends of the tension springs 700 are fastened on the rear housing 200 and rear ends of the tension springs 700 are separately fastened on the two racks 300. In this embodiment, when the helmet needs to be turned down, the knob outer ring 510 is rotated and the knob outer ring 510 drives the gear stand 530 to turn. Because the gear ring matching the gear stand 530 with the lock 611 of the knob lock 610 is unidirectional, the gear stand 530 and the lock 611 are unlocked by using a slope effect between the unidirectional gear ring 531 and the lock 611. The gear stand 530 turns and drives the gear 420 to turn and the gear 420 drives the two racks 300 to become contracted relatively. Consequently, the front housing 100 moves backwards and the helmet is turned down. In this process, the rear ends of the two tension springs 700 separately move with the two racks 300, the two tension springs 700 are elongated and when the helmet is adjusted to a proper position, the knob outer ring 510 is loosened, the knob lock 610 again matches the unidirectional gear ring 531 of the gear stand 530 for locking under an elastic pressure effect of the elastic element 630, the gear stand 530 and the gear 420 cannot turn, and therefore, the front housing 100 and the rear housing 200 are relatively fixed; when a user is in a massaging process and feels that massaging strength is too intense to bear or does not want massaging, or want to turn up the helmet, the user presses the upper cover 620 of the knob lock and uses the elastic element 630 to move the knob lock 610 in reverse to unlock the gear stand 530. In this way, the gear stand 530 can be turned, the gear 420 is no longer restricted, the tension springs 700 are released, and the front housing 100 immediately rebounds forwards, thereby enlarging spacing between the front housing 100 and the rear housing 200, that is, the helmet is turned up. In the size adjusting structure provided in this embodiment, a knob and a button are designed as a whole, helmet adjustment is implemented by using two manners, this operation structure is more convenient, and an inner structure is more reliable.

Figure 7:
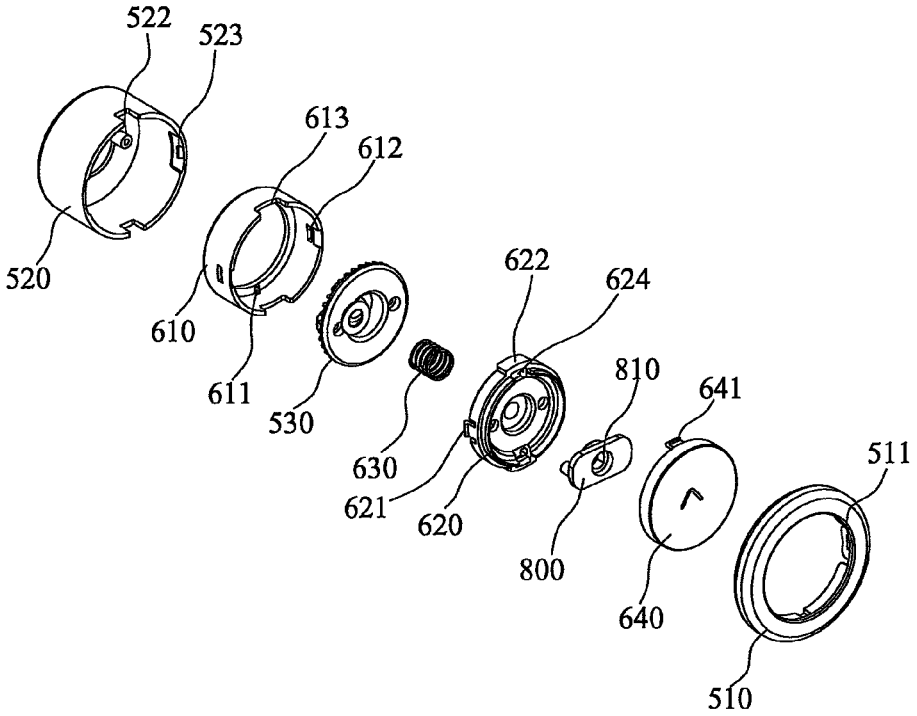
FIG. 7 is an exploded view of a knob component and a locking component of a head massager according to an embodiment of the present invention.
Figure 8:
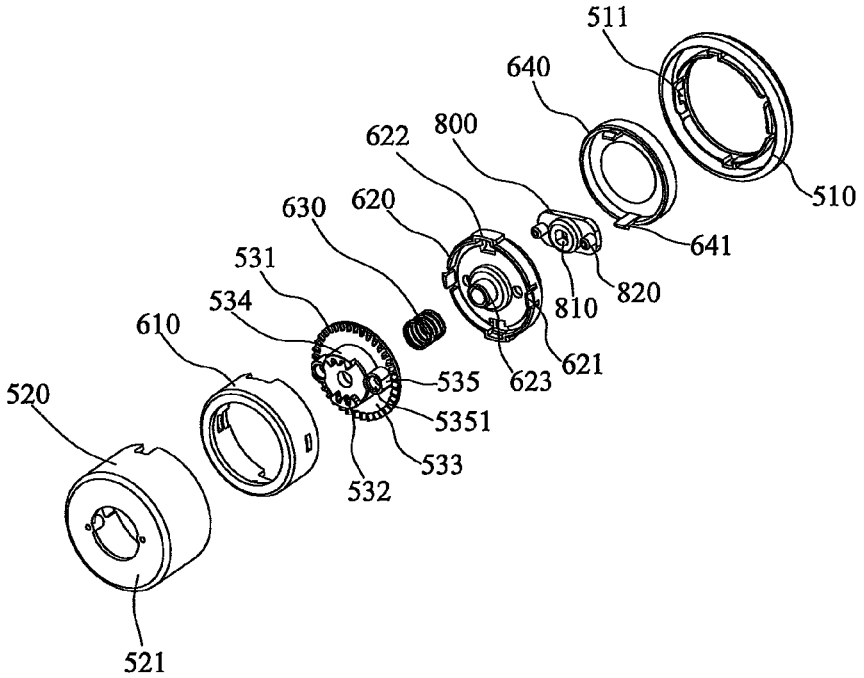
FIG. 8 is an exploded view of a knob component and a locking component of a head massager that are observed from another perspective according to an embodiment of the present invention.
Figure 9:
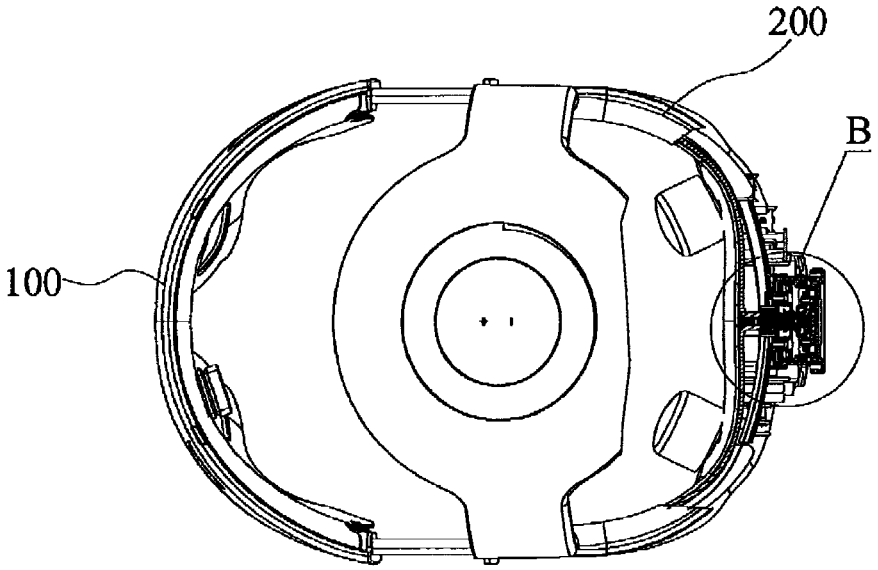
FIG. 9 is a sectional view 1 of a helmet of a head massager according to an embodiment of the present invention.
Figure 10:
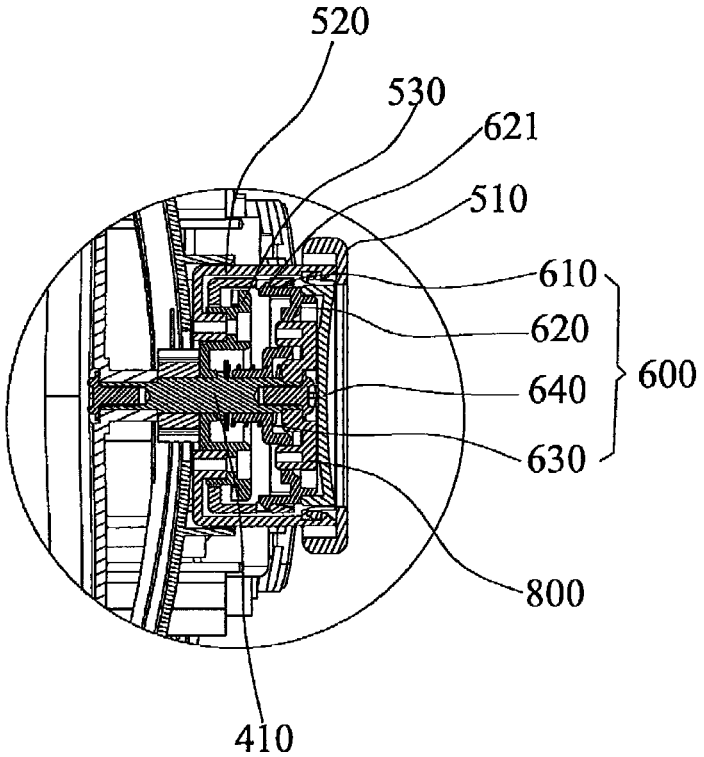
FIG. 10 is an enlarged view of a position B of FIG. 9.
Figure 11:
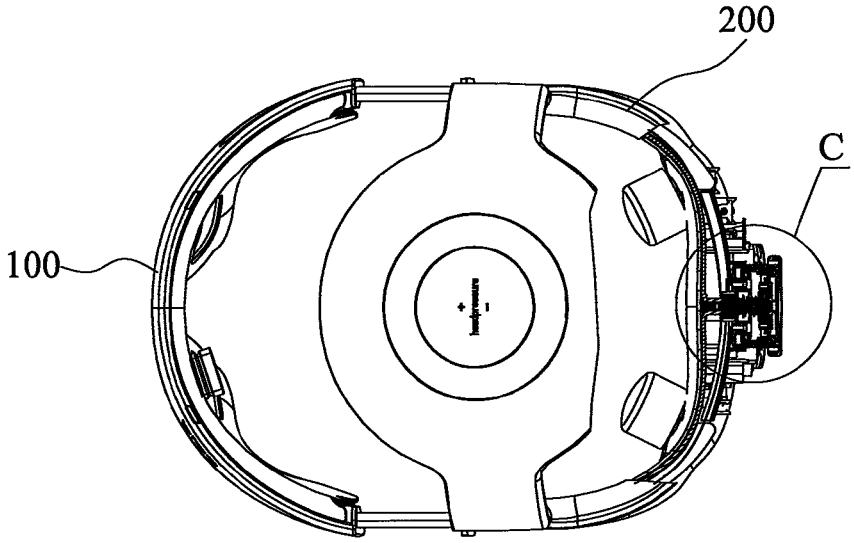
FIG. 11 is a sectional view 2 of a helmet of a head massager according to an embodiment of the present invention.
Figure 12:
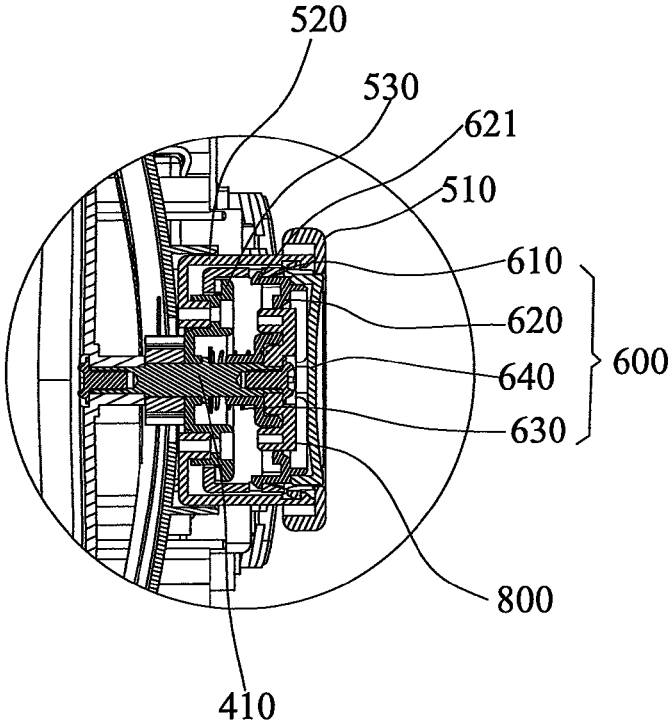
FIG. 12 is an enlarged view of a position C of FIG. 11.

Specifically, referring to FIG. 7 and FIG. 8, the gear stand 530 includes a disk-shaped base body 533 and a cylindrical protrusion 534 that is disposed on a center of the base body 533, the unidirectional gear ring 531 is arranged by surrounding one surface of the base body 533, and the protrusion 534 is disposed on a same surface with the unidirectional gear ring 531. Teeth 532 are disposed on the protrusion 534, and the teeth 532 are in two groups and arranged in opposition to each other. The two groups of teeth 532 are located on a circumference of the protrusion 534. In this way, both the two groups of teeth 532 can be engaged with the gear 420.

In this embodiment, the knob outer ring 510, the knob shell 520, and the gear stand 530 are fastened as a whole to form the foregoing knob component 500 and the knob outer ring 510, the knob shell 520, and the gear stand 530 can rotate together. Specifically, a connection relationship among the knob outer ring 510, the knob shell 520, and the gear stand 530 is as follows: two mounting studs 535 are further disposed on the base body 533 of the gear stand 530, the two mounting studs 535 are arranged symmetrically to the protrusion 534, and a mounting hole 5351 is disposed on each mounting stud 535; the knob shell 520 is of a tubular structure, with a base plate 521 on one end and no base plate on the other end that is in a shape of a full opening; a central hole is disposed on the base plate 521, and connecting pins 522 that can separately extend into the mounting holes 5351 are disposed correspondingly on an inner side of the base plate 521, and in this way, the gear stand 530 and the knob shell 520 are fastened by matching the connecting pins 522 with the mounting holes 5351; in addition, the knob outer ring 510 is of a loop structure and two connecting holes 511 are disposed on an inner side of the knob outer ring 510 and connecting bumps 523 that can be separately clamped into the two connecting holes 511 are disposed on an inner side of the knob shell 520; in this way, the knob shell 520 and the knob outer ring 510 are fastened by matching the connecting bumps 523 with the connecting holes 511, and therefore, with the foregoing structure, the knob outer ring 510, the knob shell 520, and the gear stand 530 are connected as a whole.

Referring to FIG. 7 and FIG. 8 again, a knob lock 610 is of a hollow tubular structure, and a first card slot 612 is disposed on an inner wall of the knob lock 610; an upper cover 620 of the knob lock is of a circular cover structure and a first card hook 621 extending to an inner side is disposed on the upper cover 620 of the knob lock, and the first card hook 621 is disposed inside the first card slot 612, with the hook extending outwards. Further, two openings 613 are further disposed on the tubular wall of the knob lock 610 and card blocks 622 that can be separately clamped into the two openings 613 are disposed on the upper cover 620 of the knob lock. In this way, the matching between the openings 613 and the card blocks 622 not only facilitates positioning when the knob lock 610 and the upper cover 620 of the knob lock are installed, but also more tightly connects the knob lock 610 and the upper cover 620 of the knob lock.

Referring to FIG. 9 to FIG. 12, in this embodiment, a boss 623 extends from a center of an upper cover 620 of a knob lock to an inner side, an elastic element 630 is sleeved on the boss 623, a revolving shaft 410 passes through a center of the boss 623, one step 411 is disposed on the revolving shaft 410, and another end of the elastic element 630 presses against the step 411. Specifically, the elastic element 630 is a spring. Because the first card hook 621 on the upper cover 620 of the knob lock is disposed inside the first card slot 612 of a knob lock 610, with the hook extending outwards, the elastic element 630 is in contracted state during pre-assembly and imposes outward force to the upper cover 620 of the knob lock, the force also indirectly enables the first card hook 621 to impose outward force on the first card slot 612. At this time, the knob lock 610 also receives outward force, and therefore, the knob lock 610 is more tightly matched with the gear stand 530.

Further, to prevent the upper cover 620 of the knob lock from turning, an anti-rotating spacer 800 is further fastened on the upper cover 620 of the knob lock. Specifically, the anti-rotating spacer 800 is of a rectangular block structure, a central hole 810 is disposed on the anti-rotating spacer 800, and an end of the revolving shaft 410 extends out of the central hole 810 and is fastened by using a screw. Because the revolving shaft 410 is fastened with a rear housing 200 and cannot be turned, the anti-rotating spacer 800 is also fixed and cannot be turned. In addition, the anti-rotating spacer 800 is also fastened on the upper cover 620 of the knob lock, and therefore, the upper cover 620 of the knob lock also cannot be turned. Specifically, a connecting shaft 820 that is correspondingly inserted into the upper cover 620 of the knob lock is disposed on the anti-rotating spacer 800, and the anti-rotating spacer 800 is fastened on the upper cover 620 of the knob lock by using the connecting shaft 820.

In this embodiment, to better press the upper cover 620 of the knob lock, a knob button 640 is further disposed on an outer side of the upper cover 620 of the knob lock, the knob outer ring 510 is hollow inside, and the knob button 640 is exposed in a hollow hole of the knob outer ring 510, thereby facilitating pressing of the knob button 640. Specifically, a second card slot 624 is disposed on the upper cover 620 of the knob lock and a second card hook 641 that can be clamped into the second card slot 624 is disposed on the knob button 640. In this way, the knob button 640 is fastened on the upper cover 620 of the knob lock by matching the second card slot 624 with the second card hook 641.

Referring to FIG. 10 again, when a helmet needs to be turned down, a knob outer ring 510 is rotated and the knob outer ring 510 drives a gear stand 530 to turn. Because the gear ring matching the gear stand 530 with a lock of a knob lock 610 is unidirectional, the gear stand 530 and the lock 611 are unlocked by using a slope effect between the unidirectional gear ring 531 and the lock 611. The gear stand 530 turns and drives the gear 420 to turn and the gear 420 drives two racks 300 to become contracted relatively. Consequently, a front housing 100 moves backwards and the helmet is turned down. In this process, rear ends of two tension springs 700 separately move with the two racks 300, the two tension springs 700 are elongated and when the helmet is adjusted to a proper position, the knob outer ring 510 is loosened, the knob lock 610 moves outwards under the pressure effect of the elastic element 630, so that the lock 611 on the knob lock 610 again matches the unidirectional gear ring 531 of the gear stand 530 for locking, the gear stand 530 and the gear 420 cannot turn, and therefore, the front housing 100 and a rear housing 200 are relatively fixed.

Referring to FIG. 12 again, when a user is in a massaging process and feels that massaging strength is too intense to bear or does not want massaging, or want to turn up a helmet, the user presses a knob button 640, rotates an upper cover 620 of a knob lock to move inwards, and pushes a knob lock 610 to move inwards and in this way, a lock 611 on the knob lock 610 and a gear stand 530 are unlocked, the gear stand 530 can be turned, a gear 420 is no longer restricted, tension springs 700 are released, a front housing 100 immediately rebounds forwards, a rack 300 is moved and reset under an effect of the tension springs 700, thereby enlarging spacing between the front housing 100 and a rear housing 200, that is, the helmet is turned up.

In conclusion, in this embodiment, size adjustment is implemented by using two operation manners, rotating and pressing, thereby making the operation easier. In addition, adjusting structures are combined as a whole, and therefore, the structures are more simplified, the cost is lower, and product reliability and market competitiveness are improved.

The foregoing descriptions are merely exemplary embodiments of the present invention, but are not intended to limit the present invention. Any modification, equivalent replacement, or improvement made without departing from the spirit and principle of the present invention shall fall within the protection scope of the present invention.

What is claimed is:

1. A helmet size adjusting structure, wherein the structure is disposed between a front housing and a rear housing of a helmet of a head massager and comprises two racks that connect the front housing and the rear housing; rear ends of the two racks overlap each other, and an overlapping part is relatively contracted or expanded by using an adjusting apparatus; the adjusting apparatus comprises a revolving shaft that extends from outside to inside and a gear disposed on an inner end of the revolving shaft, an upper part and a lower part of the gear are separately engaged with the racks, and a knob component and a locking component that locks the knob component are further disposed on an outer end of the revolving shaft; and the helmet size adjusting structure further comprises two tension springs, wherein front ends of the tension springs are fixed on the rear housing and rear ends of the tension springs are separately fixed on the two racks; the knob component comprises a knob outer ring, a knob shell that matches the knob outer ring, and a gear stand that is disposed inside the knob shell and can turn with the knob outer ring and the knob shell; the locking component comprises a knob lock disposed inside the knob outer ring and the knob shell, an upper cover of the knob lock that is clamped with the knob lock, and an elastic element; the gear stand is located inside the knob lock, a unidirectional gear ring is disposed on the gear stand, a lock that can be clamped on the unidirectional gear ring is disposed on the knob lock, and the elastic element is disposed on the upper cover of the knob lock and configured to press against the upper cover of the knob lock so as to press on the knob lock, thereby matching the lock with the unidirectional gear ring for locking; teeth are further disposed on the gear stand, wherein the teeth pass through the knob lock and the knob shell in turn to engage with the gear.

2. The helmet size adjusting structure according to claim 1, wherein the gear stand comprises a base body and a protrusion on the base body, the unidirectional gear ring is arranged by surrounding one surface of the base body, the teeth are disposed on the protrusion, and the teeth are in two groups and arranged in opposition to each other.

3. The helmet size adjusting structure according to claim 2, wherein: two mounting studs are further disposed on the base body, the two mounting studs are arranged symmetrically to the protrusion, a mounting hole is disposed on each mounting stud, and connecting pins that can separately extend into the mounting holes are disposed correspondingly on the knob shell; two connecting holes are disposed on an inner side of the knob outer ring and connecting bumps that can be separately clamped into the two connecting holes are disposed on an inner side of the knob shell.

4. The helmet size adjusting structure according to claim 1, wherein a first card slot is further disposed on an inner side of the knob lock, a first card hook extending to an inner side is disposed on the upper cover of the knob lock, and the first card hook is disposed inside the first card slot, with the hook extending outwards.

5. The helmet size adjusting structure according to claim 1, wherein: a boss extends from a center of the upper cover of the knob lock to the inner side, the elastic element is sleeved on the boss, the revolving shaft passes through a center of the boss, one step is disposed on the revolving shaft, and another end of the elastic element presses against the step.

6. The helmet size adjusting structure according to claim 5, wherein one anti-rotating spacer is further fastened on the upper cover of the knob lock.

7. The helmet size adjusting structure according to claim 6, wherein a central hole is disposed on the anti-rotating spacer, an end of the revolving shaft extends out of the central hole and is fixed by using a screw, and a connecting shaft that is correspondingly inserted into the upper cover of the knob lock is further disposed on the anti-rotating spacer.

8. The helmet size adjusting structure according to claim 1, wherein a knob button is further disposed on an outer side of the upper cover of the knob lock, the knob outer ring is hollow inside, and the knob button is exposed in a hollow hole of the knob outer ring.

9. The helmet size adjusting structure according to claim 8, wherein a second card slot is disposed on the upper cover of the knob lock and a second card hook that can be clamped into the second card slot is disposed on the knob button.

10. A head massager, comprising a helmet, wherein the size adjusting structure according to claim 1 is disposed symmetrically on the helmet.

* * * * *